United States Patent [19]

Olsen, Jr. et al.

[11] Patent Number: 4,709,538

[45] Date of Patent: Dec. 1, 1987

[54] APPARATUS FOR FEEDING AND OPENING A BEVERAGE CARRIER

[75] Inventors: Peter C. Olsen, Jr.; Peter M. Conforto, both of Monroe; Jimmy R. Craighead, West Monroe, all of La.; David L. Wolf, Cedar Falls, Iowa

[73] Assignee: Manville Corporation, Denver, Colo.

[21] Appl. No.: 861,470

[22] Filed: May 9, 1986

[51] Int. Cl.[4] ..... B65B 43/24

[52] U.S. Cl. ..... 53/566; 53/564; 53/579; 53/381 R; 493/177; 493/182; 493/319

[58] Field of Search ..... 53/381 R, 457, 458, 53/564, 566, 579; 493/177, 181, 182, 309, 318, 319

[56] References Cited

U.S. PATENT DOCUMENTS

| | | | |
|---|---|---|---|
| 1,289,673 | 12/1918 | Cooper | 493/319 |
| 2,769,376 | 11/1956 | Chidsey et al. | 493/319 |
| 2,968,226 | 1/1961 | Derderian | 493/319 |
| 2,989,903 | 6/1961 | Wilcox | 493/181 |
| 3,108,515 | 10/1963 | Stohlquist | 493/309 |
| 4,034,658 | 7/1977 | Sherman | 493/177 |

FOREIGN PATENT DOCUMENTS

| | | | |
|---|---|---|---|
| 225462 | 11/1958 | Australia | 53/566 |

*Primary Examiner*—Robert L. Spruill
*Assistant Examiner*—Donald R. Studebaker
*Attorney, Agent, or Firm*—John D. Lister; Cornelius P. Quinn; Timothy R. Schulte

[57] ABSTRACT

A machine for feeding a collapsed beverage can carrier sleeve to a flight bar conveyor and introducing the sleeve in fully open condition to the pocket of the conveyor. After leaving the feed rolls the collapsed carrier sleeve is moved through a fixed guide by lugs on a movable chain. The end flaps on the upwardly facing side panel are held in place on the guide while the end flaps on the downwardly facing side panel are moved downwardly by a fixed cam surface. The substantially opened sleeve is then either given a final kick by rotating arms or is propelled by the feed lugs to accelerate it into the pocket while at the same time fully straightening and opening the sleeve. The carton dimension corresponding to the length of the pocket is the same as the length of the pocket, resulting in more pockets per conveyor length and permitting operation at slower conveyor speeds.

5 Claims, 11 Drawing Figures

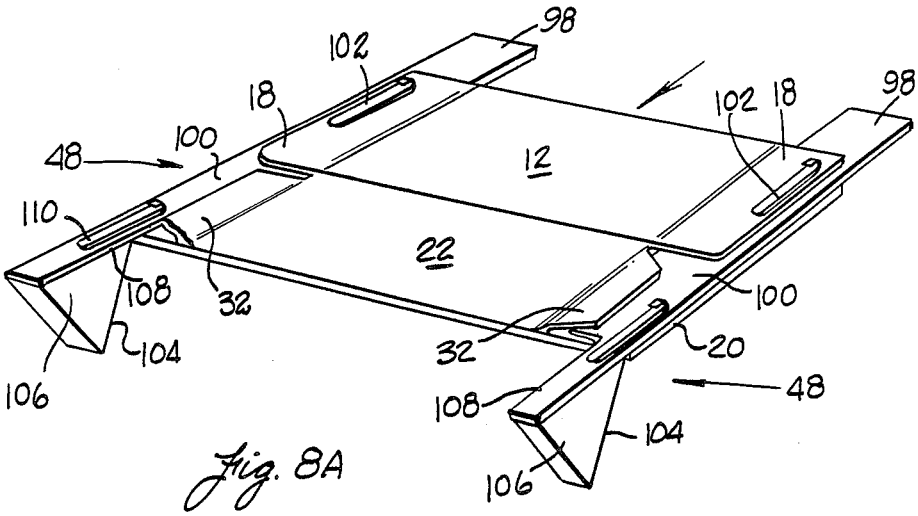
Fig. 8A
Fig. 8B
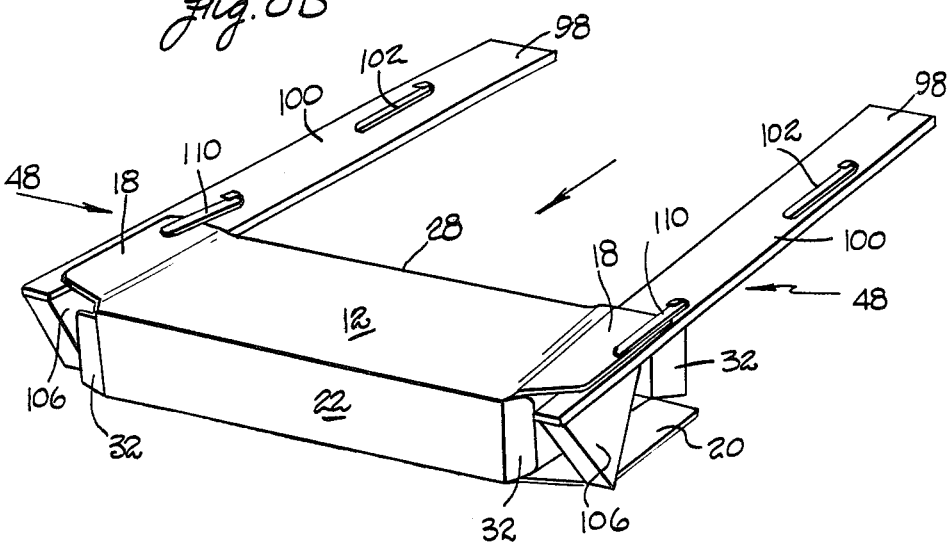

APPARATUS FOR FEEDING AND OPENING A BEVERAGE CARRIER

FIELD OF THE INVENTION

This invention relates to a method and apparatus for opening a collapsed beverage carrier to allow it to be loaded with containers, and more particularly it relates to a method and apparatus for opening a collapsed container while it is being fed to a flight bar transportation station.

BACKGROUND OF THE INVENTION

A common type of carrier often used to package twelve or twenty-four beverage cans is the sleeve-type carrier. Such a carrier completely encloses the cans and is typically formed from a generally rectangular paperboard production blank which has been folded and glued by the blank manufacturer to form an interim sleeve-like product consiting of connected top, bottom and side panels. This interim product is shipped in flat collapsed form to the bottler who, through use of an automatic packaging machine, opens the semi-formed blank into its sleeve shape, inserts the cans into the sleeve and forms the end panels by gluing together flaps which are foldably connected to the blank.

After being fed to the packaging machine the collapsed blanks are partially opened while being delivered to a pocket formed between adjacent flight bars attached to moving endless chains. The blank opening process is completed in the pocket as the pocket moves with the chains to the container loading station.

This arrangement has several disadvantages. It is sometimes difficult to open the collapsed blanks after they have been stored for any length of time between their manufacture and their introduction to the packaging machine. The weight of the stacked blanks tends to press the opposed faces of a blank together to such an extent that they become difficult to separate, thus making it difficult for the packaging machine to open the collapsed blanks into sleeve form. In addition, when the blanks are stored under humid conditions they often warp, which tends to inhibit the ability of the passive blank opening guides to open the blank. Further, the process of opening or completing the opening of a blank while the blank is in the pocket between flight bars requires a considerable amount of working space, requiring the flight bars to be spaced a relatively great distance apart. This makes it necessary to run the flight bar chains at higher speeds than would normally be preferred in order to maintain packaging speeds consistent with the high speeds at which beverage containers can be delivered to the loading station. It would thus be beneficial to reduce the size of the flight bar pockets and to have a more positive carton opening means which is capable of overcoming the difficulties in opening warped or compressed blanks.

BRIEF SUMMARY OF THE INVENTION

This invention provides a positive means for opening a carrier blank by moving the blank through a zone in which the upper end flaps are securely held while the lower end flaps are forced downwardly away from the upper flap. By allowing the panel portions between the flaps to be moved in response to the relative movement of the upper and lower flaps, the panels are able to pivot about their connecting folds to place the blank into a substantially open condition. Continued positive feeding of the substantially open sleeve or application of an impact force against the panels adjacent the trailing folds of the blank just prior to entering the pocket causes the blank to be introduced to the pocket in fully open condition. The distance between flight bars can therefore correspond to the height of the side panels of the carrier, allowing the carrier to fit snugly in the pocket.

These and other features and aspects of the invention, as well as its various benefits, will be made more clear in the detailed description of the invention which follows.

BRIEF DESCRIPTION OF THE DRAWINGS

FIGS. 8A and 8B are pictorial schematic views of the sequence of engagement of a collapsed carrier sleeve with the elements of a stationary opening guide as it moves along the guide;

DESCRIPTION OF THE INVENTION

Figure 1:
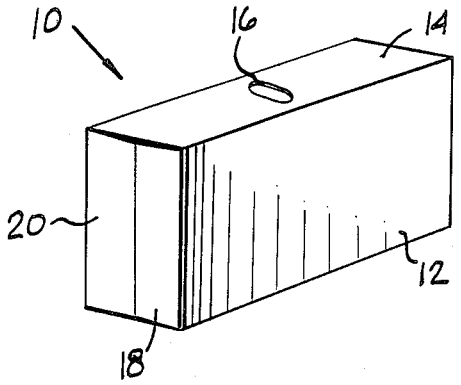
FIG. 1 is a pictorial representation of a completely formed beverage carrier of the type adapted to be opened by the present invention.

Referring to FIG. 1, reference numeral 10 indicates a fully formed beverage carrier having side panels 12, an upper panel 14 containing a handle opening 16, a bottom panel on which the carrier is resting and therefore is not visible, and end flaps 18 and 20 which have been glued to dust flaps inside the package to hold the end flaps in place. This is the typical design of carriers which contain twelve or twenty-four beverage cans.

Figure 2:
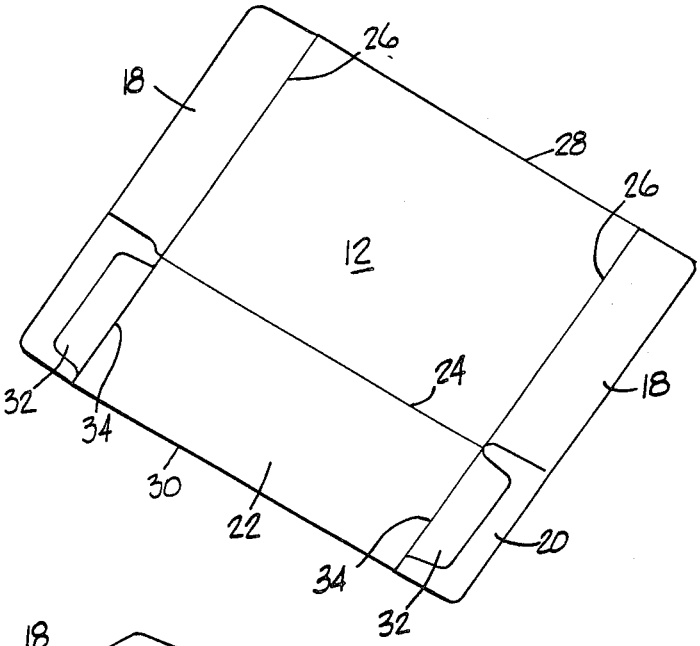
FIG. 2 is a pictorial representation of a carton blank which has been formed into a collapsed sleeve.

Such carriers are erected from generally rectangular blanks of paperboard which are formed into collapsed sleeves of the type shown in FIG. 2, which shows a side panel 12, bottom panel 22 and upper and lower end flaps 18 and 20. The bottom panel 22 is connected to the side panel 12 by fold 24 and the upper end flaps are connected to the side panel 12 by folds 26. The side panel 12 is connected by fold 28 to the flattened upper panel 14, not shown but situated on the underside of the collapsed sleeve, and bottom panel 22 is connected to the underlying side panel by fold 30. It should be understood that the underlying side panel is also connected to the folded upper panel by a fold similar to the fold 24 connecting the panel 12 with the bottom panel 22. Also shown are dust flaps 32 which are connected by folds 34 to the bottom panel 22. Similar dust flaps, hidden from view, are foldably connected to the upper panel.

Figure 3:
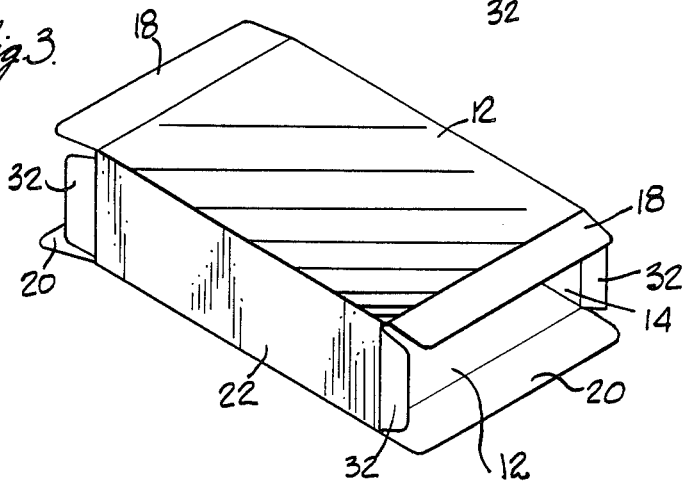
FIG. 3 is a pictorial representation of the collapsed sleeve of FIG. 2 after it has been opened.

The collapsed sleeve of FIG. 2 is opened into the fully open condition shown in FIG. 3 prior to filling the carrier with beverage cans. As can be seen, the upper and bottom panels 14 and 22 have been swung up to vertical and the side panels 12 are foldably connected to them at substantially right angles. This allows the cans to be inserted from both ends, after which the dust flaps 32 are folded shut and the end flaps 18 and 20 glued to them, forming the carrier configuration shown in FIG. 1.

Figure 4:
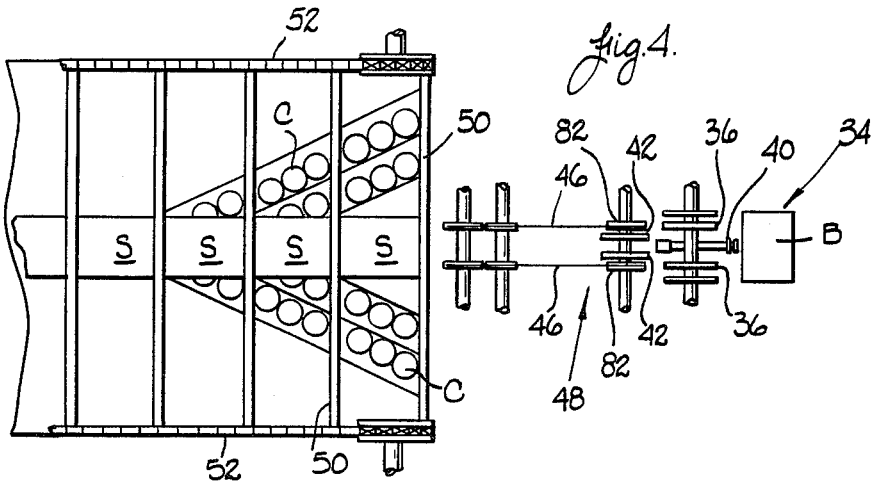
FIG. 4 is a schematic plan view of the machine of the present invention, showing typical container loading means.
Figure 5:
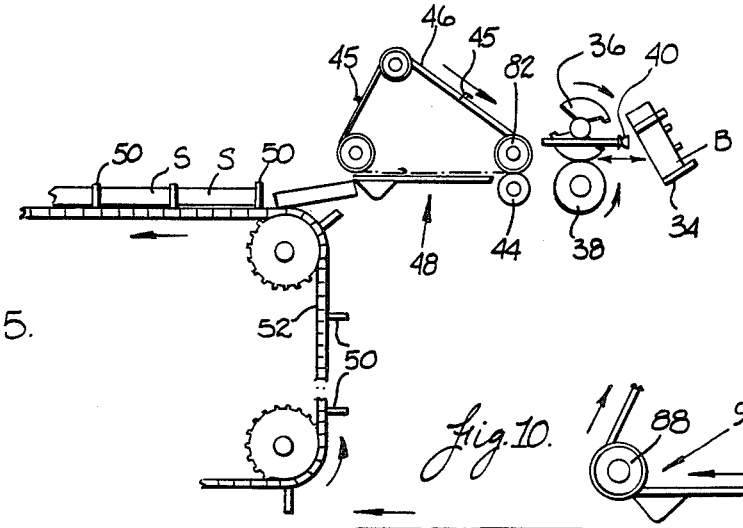
FIG. 5 is a schematic side elevation of the machine of FIG. 4.

The apparatus for feeding and opening the collapsed carrier sleeves is shown schematically in FIGS. 4 and 5. A hopper 34 holds a stack of collapsed sleeve blanks B and the bottom blank in the stack is pulled into initial feed rolls 36 and 38 by an oscillating suction cup 40. The blank is then introduced to the nip rolls 42 and 44 which, as will be explained in more detail hereinafter, act in concert with feed lugs 45 on endless chains 46 to drive the blank through a stationary guide and opening means 48. The opened sleeves S are then deposited in the pockets formed between the flight bars 50 which are attached at their ends to endless chains 52. The flight bars 50 also function to push groups of cans C along converging paths, continued movement of the cans causing them to be moved into the open ends of the sleeves after which the end flaps are adhered to the dust flaps. The converging movement of the cans into the open sleeves and the subsequent closing and sealing of the end flaps are conventional practices and may be carried out by any satisfactory means.

Figure 6:
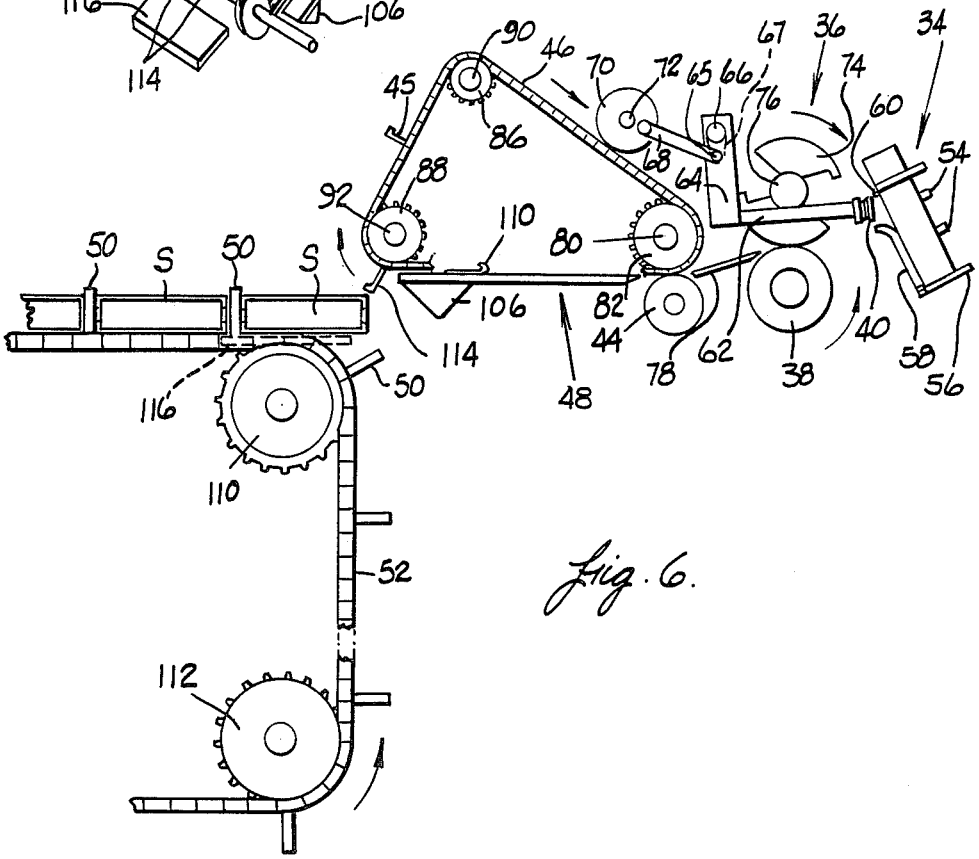
FIG. 6 is a side elevation, with some components eliminated for purpose of clarity, of the carton opening portion of the packaging machine.

Referring to FIG. 6, the carrier sleeve opening means of the present invention is shown in more detail. The hopper 34 is slightly tilted in the downstream direction and includes side guide bars 54 and lower support bars 56, the spaced arrangement of which facilitates introduction of the blanks to the hopper by an operator. In addition, the bottom edge of the lowermost blank is supported by sheet metal strips 58 which can be seen to extend upwardly for a substantial distance and then for a short distance in a generally downstream direction. The upper edge of the lowermost blank is held in place by a short flange 60. The vacuum cup 40 is situated just below the upper flange 60 when in operative position and is mounted on the end of support arm 62. The support arm 62 extends transversely from a plate 64 mounted on shaft 65 for movement therewith. The shaft 65 is connected by means of arm 67, which is hidden in this view by plate 64 and is therefore shown in dotted lines, to pin 66 for pivotal movement about pin 66. The shaft 65 is pivotally attached to arm 68 of crank mechanism 70 so that upon rotation of the shaft 72 the shaft 65 pivots about pin 66, causing the plate 64, and hence the vacuum cup 40 also, to oscillate toward and away from the stack of blanks. In operation, at the end of its oscillating movement toward the hopper 34, the vacuum cup contacts the bottom side of the lowermost blank in the stack near its upper edge. The amount of suction applied is enough to overcome the small area of support provided by the flange 60, causing the upper portion of the blank to bend or flex out of contact with the flange and the blank to be pulled up over the angled strips 58 and away from the hopper as the vacuum cup moves away from the hopper. Preferably, two spaced vacuum cups are employed to ensure that an adequate gripping force is applied to the blank, although it is possible to accomplish the task with a properly controlled centrally located vacuum cup.

As shown in FIG. 6, the initial feed rolls 36 are comprised of segments 74 mounted on rotary shaft 76 to contact the freely rotatable backer rolls 38. Preferably, the backer rolls have an elastomeric surface to increase the frictional grip of the rolls 36 and 38 on the blanks. The shape and location of the segments 74 are designed to engage the blanks in timed relation to the action of the vacuum cups so that when a blank is being pulled from the hopper by the vacuum cups, the segments do not engage their backer rolls. When the vacuum cups pull the leading edge of the lowermost blank into proximity of the nip of the initial feed rolls 36 and backer rolls 38, the vacuum is cut and the leading edge drops into the nip, at which time one of the segments 74 will have rotated into place to engage the leading edge portion of the blank against the backer roll and pull it through the nip and over the plate 78 toward the feed or nip rolls 42 and 44. The periphery of each segment is of such length that it remains in contact with, and thus continues feeding, the blank until the leading edge of the blank is gripped by the nip rolls.

Both nip rolls 42 and 44 preferably have elastomeric surfaces to facilitate gripping engagement with the blanks. Nip roll 42, which is powered, is mounted on shaft 80 which also supports sprockets 82 around which chains 46 are trained. The chains 46 are also trained around sprockets 86 and 88, mounted on shafts 90 and 92, respectively. Extending between the shafts 80 and 92, and aligned with the flap portions of the blanks, are the guides 48 for use in substantially opening the collapsed sleeves of the blanks.

Figure 7:
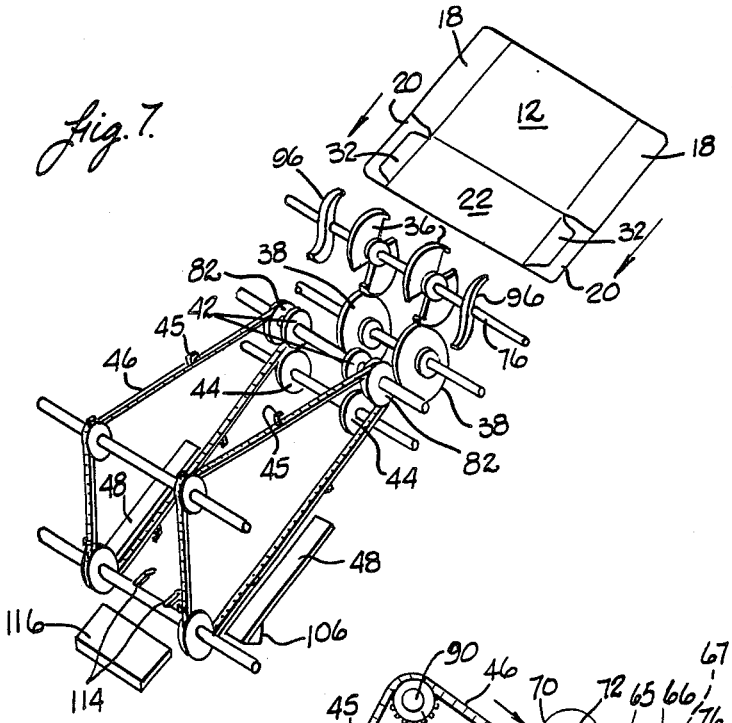
FIG. 7 is a pictorial schematic view of the carton opening portion of the packaging machine.

The overall arangement described thus far, from the initial feed rolls to the downstream end of the chains 46, is shown schematically and pictorially in FIG. 7 which better illustrates the relative arrangement of elements. As can be seen, the initial feed rolls 36 and 38 as well as the nip or feed rolls 42 and 44 are positioned to engage the blanks only on their panel sections, leaving the flap portions free to enter the guides 48. The guides 48 are thus generally aligned with the flap portions. In addition to the initial feed roll structure described above, mounted outboard of the initial feed rolls 36 on shaft 76 are tuck arms 96 which strike the leading portions of the flaps 20 to ensure separation of the opposed flaps 20 and 32 prior to entering the guides 48.

Referring back to FIG. 6 in addition to FIG. 7, the nip rolls 42 and 44 feed the collapsed sleeves into the guides 48, which extend downstream a distance greater than the distance the blank is moved by the nip rolls. The trailing edge of the blank, which corresponds to the fold 28 connecting the upper panel 12 and the top 14 of the collapsed sleeve, is contacted by lugs 45 attached to the chains 46. The lugs are spaced along the chains in such a manner that a pair of lugs will be in position to contact the trailing edge of each blank as it is about to leave the nip rolls. Thus after a collapsed sleeve leaves the nip rolls, it is continued to be propelled along guides 48 by the pushing action of chain lugs 45. After leaving the nip rolls, the central portion of the collapsed sleeve, which corresponds to the panel portions between the flaps, is unsupported even though pushed by the lugs 45, thereby permitting the sleeve to be opened as described below.

Referring now to FIGS. 6, 7, 8A and 8B, the leading edges of lower end flaps 20 are directed beneath finger 98 of guides 48 as the collapsed sleeve leaves the nip rolls 42 and 44. This is shown best in FIG. 8A, which shows the collapsed sleeve after it has traveled some distance along the guides 48, its lower end flaps 20 being situated beneath the plates 100, the leading portions of which constitute the fingers 98. As this occurs, the dust flaps 32 and upper end flaps 18 ride over the upper surface of the fingers 98 and plate 100. Continued movement of the blank takes it to the position shown in FIG. 8A, where the upper end flap 18 is lightly gripped between the base plate 100 of the guide 48 and guide plates 102. The guide plates 102 preferably take the form of leaf springs which may be attached by suitable bracket means, not shown for purpose of clarity, so that they are spaced above plates 100 a distance allowing ready passage of the flaps 18 between the guide plates and the base plates but close enough to prevent the collapsed sleeve from moving out of alignment.

In the position shown in FIG. 8A, the leading edge of the lower end flap 20 is in contact with the sloped cam surface 104 of triangular plate 106. It can be seen that the distance between the plates 100 is greater at the downstream end of the guides than at the upstream end due to the plates being notched at the downstream ends as indicated at 108. The distance between notched portions 108 is greater than the distance between the outer extremities of the dust flaps 32, which is important to the process of opening the collapsed sleeve.

Continued downstream movement of the collapsed sleeve causes the leading edge of the lower end flaps 20 to ride down the inclined cam surface 104 of plates 106, this being possible because the lower side panel 12 to which the end flaps are attached is unsupported. Because the upper end flaps 18 are slidably clamped in place by the leaf springs 102, and because further movement of the collapsed sleeve brings the bottom panel 22 and attached dust flaps 32 into the area of the notched plate portions 108, movement of the lower end flaps 20 down the inclined cam surface 104 causes a pivoting action about the fold lines of the blank to occur, resulting in the opening of the collapsed sleeve as shown in FIG. 8B. In this position the upper end flaps 18 are held in place by a second set of leaf springs 110 spaced downstream from the first set of leaf springs 102, allowing the unfolding of the collapsed sleeve to occur as the lower side panel 12 is moved downwardly away from the upper side panel during the travel of the leading edge of the flaps 20 down the cam surfaces 104. Although two sets of leaf springs or guide plates have been shown, it is possible to use just one set of longer plates instead.

In the position shown in FIG. 8B, the sleeve is in virtually its fully open condition, although still with a cross-sectional shape that is somewhat more a parallelogram than a rectangle. As shown in FIG. 6, when the opened sleeve is no longer held by the leaf springs 110 and the lugs 45 are moved by the chains 46 out of contact with the sleeve, the sleeve then drops down toward the pocket formed between successive flight bars 50. As mentioned previously, the flight bars are attached at their ends to the continuous chain 52, which is trained about sprockets 110 and 112 at its upstream end and preferably is driven by downstream drive sprockets 110, not shown.

Since the width of the pocket, or in other words the distance between flight bars, is substantially the same as the height of the side panels of the carrier (the distance between the top and bottom panels), there is very little if any margin of error in the act of depositing a fully open sleeve into the pocket. The flight bar 50 which is moving up to form the pocket will of course push against the lower portion of the trailing top panel as the flight bar moves into vertical position, thereby assisting to some degree in the final stage of the sleeve opening process. But because of the snug fit in the pocket it has been found that an additional sleeve opening assist is desirable. This is provided by the arms 114 mounted on the shaft 92 between the sprockets 88, shown in FIGS. 6 and 7. These kicker arms strike the fold 28 between the uppermost side panel 12 and the top panel 14 of the sleeve and also the area of the top panel 14 in the vicinity of the fold 28. The result is twofold. The sharp blow causes the final pivoting movement about the fold lines needed to push the sleeve configuration from its slightly parallelogram cross-sectional shape to a rectangular shape, allowing the open sleeve to fit snugly in the pocket. At the same time, movement of the sleeve as it drops from the guide 48 into the pocket of the flight bar conveyor is accelerated by the impetus given by this striking action. Thus this final kicking action results in the sleeve being fully opened at the time it enters the pocket.

Figure 9:
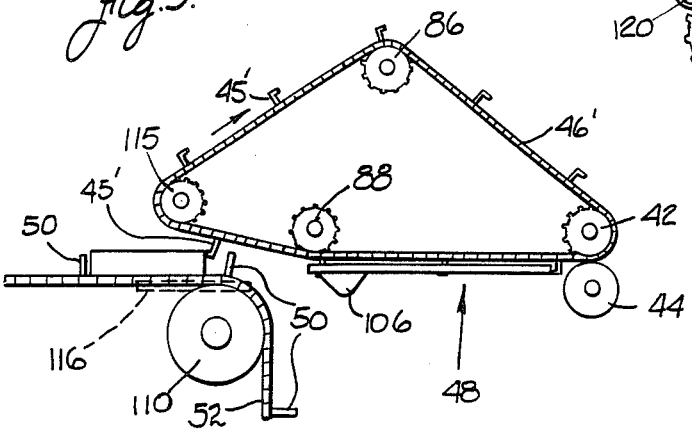
FIG. 9 is a partial side elevation of a modified arrangement of the sleeve feeding means of FIG. 6.

Another way of providing an additional sleeve opening assist is shown in FIG. 9, which shows an arrangement similar to that of FIG. 6 but wherein an additional set of sprockets 115 is located downstream from the sprockets 88. The chains 46' and lugs 45' are similar to chains 46 and lugs 45 except that the chains are trained about the sprockets 115 as well, the sprockets 115 being positioned so that the run of chains 46' is slightly uphill. As the opened sleeve leaves the guide 48 the lugs 45' in contact with the trailing portion of the sleeve continue to push the sleeve to give it added impetus in its transfer to the pocket of the flight bar conveyor. As in the case of the kicker arm action, the continued engagement of the lugs 45' with the sleeve causes the lugs to push the sleeve configuration from its slightly parallelogram crosssectional shape to a rectangular shape, so that it will fit snugly in the pocket of the flight bar conveyor. Continued movement of the lugs uphill takes the lugs out of contact with the sleeve at the appropriate time so that the lugs do not interfere with the transfer of the sleeve to the pocket.

Figure 10:
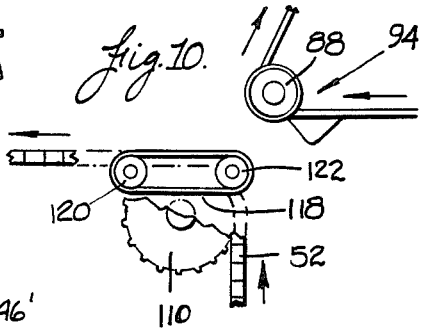
FIG. 10 is a partial side elevation of a modified arrangement of the sleeve transfer station of FIG. 6.

As shown in FIGS. 6 and 9, when the sleeve drops from the guide 48 and is either kicked into the flight bar pocket or pushed in by the lugs 45', it is supported for a brief period of time by the plate 116, located at the entry to the flight bar conveyor. The plate 116 is shown in dotted lines where it would normally be hidden from view by the sprocket 110. Although this engagement is brief, and although the plate 116 may actually take the form of several relatively narrow spaced plates, the friction between the sleeve and the plate can tend to slow down the movement of the sleeve over the plate and at high speeds may possibly cause a snag in the operation. To overcome this problem the arrangement shown in FIG. 10 may be used, wherein a short conveyor belt 118 trained about sprockets 120 and 122 is utilized instead of the plate 116 of FIG. 6. This arrangement, shown in full for purpose of clarity, would occupy the same space occupied by plate 116 in the FIG. 6 arrangement. As in the case of the plate 116, the conveyor belt may actually take the form of spaced narrow belts, preferably two spaced belts. This arrangement not only alleviates the problem of friction between the sleeve and the plate 116, but provides a positive assist in the movement of the sleeve as it is fed into the flight bar conveyor pocket, making possible higher ultimate speeds.

It should now be clear that the present invention provides a simple but highly effective means for opening a collapsed carrier sleeve prior to loading the sleeve with containers. The opening process takes place over a relatively long distance compared to other typical systems, giving the advantage of a more positive opening process which can more readily overcome warped or compressed blanks and which is less likely to experience interruptions. In addition, the opening of the sleeves prior to depositing them into the flight bar conveyor pocket allows shorter pockets to be used, which in turn permits more pockets per length of flight bar conveyor and a slower conveyor operating speed with attendant improved operating efficiencies.

Although the invention has been described with respect to beverage can carriers, obviously many of the sleeve opening features could apply to carriers for other products as well. It should further be obvious that although a preferred embodiment of the invention has been described, it is possible to make changes to certain specific details of the preferred embodiment without departing from the spirit and scope of the invention.

What is claimed is:

1. Apparatus for feeding and opening a collapsed article carrier sleeve, the sleeve having two side panels foldably connected to the bottom and top panels, the bottom panel and one of the side panels being in opposed generally parallel relationship, having been folded toward each other about their connecting fold line, and the top panel and the other side panel also being in opposed generally parallel relationship, having been folded toward each other about their connecting fold line, each side panel having end flaps foldably connected at each end of the side panel and lying in substantially the same plane as that of the side panel to which it is connected, comprising:

means for moving a collapsed carrier sleeve in a direction generally parallel to the length of the end flaps;

elongated guide means generally aligned with the end flaps of the moving collapsed carrier sleeve, the guide means comprising spaced support surfaces under which the lowermost end flaps of the collapsed carrier sleeve move and over which the uppermost end flaps of the collapsed carrier sleeve move;

retainer surfaces overlying and spaced from the support surfaces a distance allowing longitudinal movement of the uppermost end flaps therebetween but preventing significant movement of the uppermost end flaps transversely of their longitudinal travel;

a fixed stationary cam surface depending from each of the spaced support surfaces, each cam surface sloping downwardly at an angle to the horizontal and in the direction of travel of the carrier sleeve, the cam surfaces being located in the path of travel of the lowermost end flaps and extending downwardly a distance such that movement of the carrier sleeve downstream of the apparatus will cause the leading edges of the lowermost end flaps to engage the cam surfaces and to be moved downward thereby a distance which separates the lowermost end flaps from the uppermost end flaps sufficient to substantially completely open the carrier sleeve;

receptacle means moving downstream of the apparatus for receiving the opened carrier sleeve; and means for depositing the opened carrier sleeve into the moving receptacle means.

2. An apparatus according to claim 1, wherein the receptacle means for receiving the opened carrier sleeve comprises the pocket formed between successive flight bars of a flight bar conveyor, the distance between the flight bars forming the pocket being substantially the same as the height of the side panels as measured from the bottom panel to the top panel of the carrier.

3. An apparatus according to claim 2, wherein the means for depositing the opened carrier sleeve into the receptacle means includes a support surface located at the upstream end of the flight bar conveyor for supporting the opened carrier sleeve as it moves toward the pocket, the support surface comprising conveyor means for assisting the movement of the opened carrier sleeve toward the pocket.

4. An apparatus according to claim 2, wherein the means for depositing the opened carrier sleeve into the receptacle means includes means for striking the carrier sleeve at a trailing fold to both propel the sleeve toward the pocket and to complete any pivoting movement remaining of the top and bottom panels to fully open and square up the carrier sleeve, the striking means being mounted for rotation about an axis located above and extending transversely of the movement of the upper side panel, the rotation of the striking means being timed so that the striking means strikes the carrier sleeve substantially at the time the means for moving the sleeve disengages from the sleeve.

5. An apparatus according to claim 2, wherein the means for depositing the opened carrier sleeve into the receptacle comprises means for maintaining the lugs in contact with the trailing edge of the carrier sleeve after the sleeve has been opened to propel the sleeve toward the pocket.

* * * * *